US005321966A

United States Patent [19]

Backhaus

[11] Patent Number: 5,321,966

[45] Date of Patent: Jun. 21, 1994

[54] METHOD AND ARRANGEMENT FOR ROLLING WIRE AND/OR ROUND STEEL

[75] Inventor: Karl Backhaus, Duisburg, Fed. Rep. of Germany

[73] Assignee: Mannesmann Aktiengesellschaft, Dusseldorf, Fed. Rep. of Germany

[21] Appl. No.: 49,058

[22] Filed: Apr. 16, 1993

[30] Foreign Application Priority Data

Apr. 16, 1992 [DE] Fed. Rep. of Germany ..... 4213277

[51] Int. Cl.[5] ..... B21B 1/18; B21B 13/12

[52] U.S. Cl. ..... 72/235; 72/252.5; 72/366.2

[58] Field of Search ..... 72/234, 235, 252.5, 72/365.2, 366.2

[56] References Cited

U.S. PATENT DOCUMENTS

| | | | |
|---|---|---|---|
| 1,749,671 | 3/1930 | Miller | 72/234 |
| 2,140,414 | 12/1938 | Brownstein | 72/235 |
| 4,907,438 | 3/1990 | Sasaka et al. | 72/235 |

FOREIGN PATENT DOCUMENTS

| | | | |
|---|---|---|---|
| 0144807 | 6/1988 | Japan | 72/252.5 |

*Primary Examiner*—Lowell A. Larson
*Assistant Examiner*—Thomas C. Schoeffler
*Attorney, Agent, or Firm*—Cohen, Pontani Lieberman, Pavane

[57] ABSTRACT

A method and an arrangement for finish rolling wire and/or round steel on a continuously operating finish rolling block. The finish rolling block includes a plurality of work rolling sets and sizing rolling sets with essentially round sizing rolls, wherein the rolling sets are arranged closely one behind the other and the rolling planes thereof are alternatingly offset relative to each other by 90°. The method includes imparting a twist to the rolled material by asymmetrically spreading the rolled material in the two sets of rolls which precede the last set of rolls, wherein the twist imparted in the two sets of rolls has approximately the same magnitude but is directed in opposite directions, so that the rolled material is stabilized in its position in the last sizing roll pass.

3 Claims, 1 Drawing Sheet

METHOD AND ARRANGEMENT FOR ROLLING WIRE AND/OR ROUND STEEL

BACKGROUND OF THE INVENTION

1. Field of the Invention

The present invention relates to a method of finish rolling wire and/or round steel on a continuously operating finish rolling block. The finish rolling block includes a plurality of work rolling sets and sizing rolling sets with essentially round sizing rolls, wherein the rolling sets are arranged closely one behind the other and the rolling planes thereof are alternatingly offset relative to each other by 90°. The invention also relates to a pass arrangement for carrying out the method.

2. Description of the Related Art

Roll pass arrangements of the above-described type are described in German Patent 34 45 219 and have the purpose to manufacture wire and/or round steel with good tolerances, wherein the surface of the rolled material is treated carefully.

All pass arrangements have in common that at least the last pass of the rolling train formed by several roll sets is a finishing pass and has a cross-sectional shape for obtaining the desired finished cross-section of the rolled material.

In a solution known from German Patent 10 73 990, the last sizing pass is preceded by a pass having essentially straight circumferential lines forming the cross-section of an irregular hexagon which subsequently enters the circular sizing pass. It has been found that rolling of the sides of the hexagon is not possible in a single sizing pass. Rather, it has been found that the finished product has dimensional deviations due to flattened portions which remain on the product.

In order to improve the finished cross-section, it is proposed in Iron and Steel Engineer, March 1986, p. 115, to use a pass arrangement in which an oval-shaped transition pass is arranged following the last work pass, wherein the transition pass is followed by two sizing passes having essentially circular pass openings. This arrangement has the problem that the rolled material cannot be held in a stable manner in the round sizing passes. The consequence of this problem is that the wire tilts, i.e. the wire rotates about its longitudinal axis following the oval transition pass, wherein the flat areas created in the region of the gap of the oval transition pass rotate in the first and second sizing passes into the areas of the roll gaps and can remain flat. This problem also cannot be solved with greater pass fillings. Rather, greater pass filling merely result in ledge-like projections in the areas of the roll gaps. In summary, the desired improvement in tolerance cannot be obtained in a pass arrangement which uses two round sizing passes because it is not possible to hold the rolled material in the sizing passes without additional measures.

Because of the negative experiences with the above-described pass arrangement, another proposal provides to arrange as the third-to-last pass a regular hexagon, an oval transition pass as the second-to-last pass and as the last pass a circular finishing pass in the known manner. However, this solution also has the disadvantage that the slightly convexly curved circumferential portions of the rolled material leaving the transition pass end up in the subsequent round finishing pass in the areas of the roll gaps and the finished rolled material is not circular but is flat at the mentioned locations and is of insufficient quality.

In order to solve the problem discussed above, DE 34 45 219 C2 proposes an arrangement which has at the end last passes constructed as sizing passes, wherein the second-to-last sizing pass is dimensioned for an at least 8% reduction and the last sizing pass is dimensioned for a maximum 3.8% reduction, and wherein the third-to-last pass also has a pass opening with straight circumferential lines.

In addition to requiring rolling mills composed of roll sets having three rolls, the solution mentioned last has the disadvantage that rolling of the hexagonal primary material also results in problems in the two round sizing passes with respect to the guidance of the rolled material relative to its longitudinal axis. Accordingly, it is not possible to hold the rolled material in the pass in a stable manner in this known rolling mill.

As is clear from the above discussion of the prior art, it has been a problem for a long time to obtain in rolling mill trains of the above-mentioned type a rolled material which is accurate to size, i.e., is rolled with narrow tolerance fields. The prior art developments show that better results are obtained if more than only one circular sizing pass is used for finish rolling of the wire or round steel. However, the disadvantage for guidance of the rolled material remains. A significant improvement of the quality obtainable by means of precision rolls would be possible if finish rolling of the material can be carried out by means of at least three successive sizing passes using essentially circular pass shapes, without producing quality reductions due to turning of the previously created thickened portion of the rolled material into the areas of the subsequent roll passes in which the thickened portions can no longer be rolled down.

SUMMARY OF THE INVENTION

Therefore, it is the primary object of the present invention to provide a method, and a specific pass arrangement for carrying out the method, for finish rolling of wire and/or round steel, wherein the rolled material has a particularly good quality with narrow tolerance fields, even when high rolling speeds are used.

In accordance with the present invention, the method of finish rolling of wire and/or round steel includes imparting a twist to the rolled material by asymmetrically spreading the rolled material in the two sets of rolls which precede the last set of sizing rolls, wherein the twist imparted in the two sets of rolls has approximately the same magnitude, and wherein the twists in the two roll sets are directed in opposite directions, so that the rolled material is stabilized in its position in the last sizing roll pass.

Thus, in the prior art, as described, for example, in DE 34 45 219 C2, it was attempted to obtain stability of the rolled material in the third-to-last roll set by imparting a hexagonal cross-section to the rolled material whose straight circumferential lines counteracted a rotation of the rolled material. The method according to the present invention operates differently. Instead of preventing rotation of the rolled material, the present invention proposes method steps which have the purpose to produce an intentional rotation of the rolled material in the third-to-last stand in a predetermined direction, wherein this rotation is simultaneously prevented by oppositely directed measures in the subsequent pass which have the purpose to compensate for the intended rotation in the third-to-last stand. As a result, a stable alignment of the rolled material in the two closely successive passes is obtained, so that the rolled material enters the following finishing pass in a stable position.

A pass arrangement for carrying out the method according to the present invention in a rolling mill of the above-described type includes three last roll sets as sizing roll sets for finish rolling with small pass reduction. The three roll sets have a round initial pass, a round intermediate pass and a round finishing pass, respectively. The round initial pass and the round intermediate pass have asymmetrical pass cross-sections obtained by opening a groove portion of each groove half of each pass by increasing the radius thereof, wherein the opened groove portions in both passes are arranged on different sides of the respective groove halves.

The asymmetrical widenings of the pass cross-sections in the round initial and intermediate passes affect the above-described centering of the rolled material in the two successive passes because the twist of the wire imparted by the asymmetrical arrangement is cancelled when the wire travels through both passes. This makes it possible to carry out finish rolling of the material in three successive round passes, so that the rolled material leaving the rolling mill with a circular cross-section has excellent surface quality and stable tolerance.

In accordance with a particularly advantageous further development of the invention, the groove portion angles between the groove bottom and the roll gap of the two diametrically oppositely located pass portions of a pass are different. This means that the roll gap on always one side of the pass is located eccentrically, so that the resulting different diameters of the rolls result in additional asymmetrical conditions at the respective groove portions for reducing the intended twist in opposite directions in the round initial pass and the round intermediate pass. In summary, the present invention provides an excellent guidance of the rolled material in the pass arrangement round/round/round which follows the conventional oval pass of a preceding last work roll set.

A side effect of the pass arrangement according to the present invention of great significance is the fact a thickness reduction at the top and bottom of the rolled material is obtained because of the material of the forward and rearward ends with increased thickness are received in the opened groove portions and are rolled in a defined position in the following pass of the subsequent roll set. In addition to the already described advantages, this also increases the productivity of the rolling mill because end losses can be minimized.

The present invention can be utilized in rolling blocks having at least four successive roll sets, wherein the pass preceding the pass arrangement according to the present invention is a work pass. There is no upper limit with respect to the number of roll stands. However, a particular advantage provided by the present invention is the fact that, because of the integration of the sizing rolls composed of three sizing passes in a finishing block, threading of the rolled material into the first sizing roll set is facilitated by the still relatively low inlet speed of the rolled material into the finishing block corresponding to the number of work stands. This means that problems as they occur during threading in conventional sizing mills following finishing blocks are safely eliminated.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described a preferred embodiment of the invention.

DETAILED DESCRIPTION OF THE DRAWING

DESCRIPTION OF THE PRESENTLY PREFERRED EMBODIMENT

Figure 1:
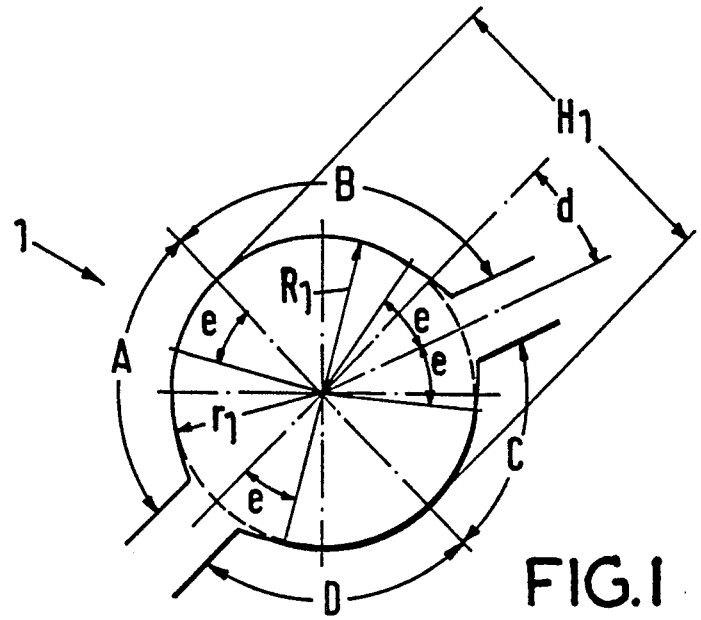
FIG. 1 is a schematic illustration of an initial pass used in the pass arrangement according to the present invention.
Figure 2:
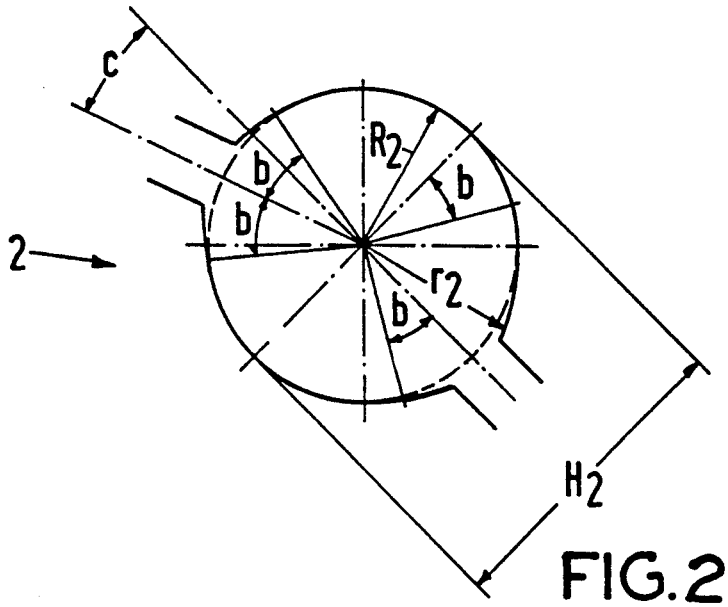
FIG. 2 is a schematic view of an intermediate pass.
Figure 3:
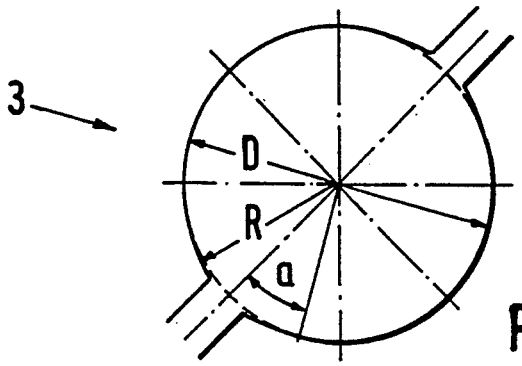
FIG. 3 is a sectional view of a finishing pass.

The drawing shows the three successive passes according to the present invention. FIG. 1 shows the round initial pass 1, FIG. 2 shows the round intermediate 2 and FIG. 3 shows the round finishing pass 3.

The initial pass is defined by the adjustment height H1, the twist angle d as well as the nominal radius R1 and the clearance radius r1 whose transition is determined by the clearance angle e relative to the roll axes. Because of the different radii, a displacement of the center points of the radii occurs for the clearance radius r1 as well as for the nominal radius R1. The twist angle d determines the unilateral roll gap misalignment from the horizontal roll plane and determines the direction and magnitude of the twist.

It should be pointed out that the slight opening of the groove in the areas of the roll gaps as shown in the drawing is conventional and has nothing to do with the clearance radius r1 according to the present invention.

In order to illustrate the different groove portion angles between the bottom of the grooves and the roll gap, these angles are shown in FIG. 1 illustrating the initial round pass 1 and are designated by A through D. Thus, FIG. 1 shows the different diametrically oppositely located groove portion angles A and C as well as B and D which results in the unilateral roll gap misalignment.

Similar to the round initial pass shown in FIG. 1, the round intermediate pass shown in FIG. 2 is defined by the adjustment height H2, the twist angle c as well as the nominal radius R2 which is displaced relative to the center point and the clearance radius r2 whose transition is determined relative to the roll axes by the clearance angle b. The twist angle c determines the unilateral roll gap misalignment from the horizontal roll plane and determines the magnitude of the twist in a twisting direction which is opposite to the twisting direction of the round initial pass.

The finishing pass has a symmetrical shape with concentric roll center and is defined by the diameter D, the clearance radius R and the clearance a.

It has been found that favorable results are obtained by means of the method of the present invention if the twist angles d and c are selected in the range between 5° and 30° and the clearance angles e and b between 15° and 35°. The total reduction from the initial pass to the finishing pass is preferably 12%.

It should be understood that the preferred embodiments and examples described are for illustrative purposes only and are not to be construed as limiting the scope of the present invention which is properly delineated only in the appended claims.

What is claimed is:

1. A method of finish rolling rolled material in the form of wire and/or round steel on a continuously operating finish rolling block including at least one set of work rolls and at least three sets of sizing rolls, wherein the sets of rolls have rolling planes, and wherein the sets of rolls are arranged closely one behind the other and the rolling planes of the sets of rolls are alternatingly offset relative to each other by 90°, the method comprising by asymmetrically spreading the rolled material imparting a twist on the rolled material in the third-to-last set of sizing rolls and imparting by asymmetrically spreading the rolled material a twist in the second-to-last set of sizing rolls, wherein the twists imparted in the third-to-last set of sizing rolls and in the second-to-last sizing rolls are directed in opposite directions and have approximately the same magnitude, whereby the rolled material is stabilized in its position in the last set of sizing rolls.

2. A pass arrangement in a continuously operating finishing roll block for rolling wire and/or round steel, comprising at least one set of work rolls and at least three sets of sizing rolls, the sets of rolls being arranged closely one behind the other, the sets of rolls having rolling planes, wherein the rolling planes of successive sets of rolls are alternatingly offset relative to each other by 90°, a third-to-last of the sets of sizing rolls defining a round initial pass, a second-to-last of the sets of sizing rolls defining a round intermediate pass and a last of the sets of sizing rolls defining a round finishing pass, each pass having a groove half including a groove portion adjacent a roll gap, each groove half having a radius, the round initial pass and the round intermediate pass having asymmetrical pass cross-sections formed by open groove portions defined by an increase of the radius of each groove portion, wherein the open groove portions are arranged in the round initial pass and in the round intermediate pass on different sides of the respective groove halves.

3. The pass arrangement according to claim 2, wherein the groove portions define a groove portion angle each between a groove bottom and the roll gap, wherein the groove portion angles of two diametrically oppositely located groove sections of each pass have a different size.

* * * * *